US011485544B2

(12) United States Patent
Netsch, Jr.

(10) Patent No.: US 11,485,544 B2
(45) Date of Patent: Nov. 1, 2022

(54) CONTAINER FOR DISPLAYING CONTENTS

(71) Applicant: Donald A Netsch, Jr., Purcellville, VA (US)

(72) Inventor: Donald A Netsch, Jr., Purcellville, VA (US)

( * ) Notice: Subject to any disclaimer, the term of this patent is extended or adjusted under 35 U.S.C. 154(b) by 85 days.

(21) Appl. No.: 16/710,145

(22) Filed: Dec. 11, 2019

(65) Prior Publication Data

US 2020/0180818 A1 Jun. 11, 2020

Related U.S. Application Data

(60) Provisional application No. 62/777,920, filed on Dec. 11, 2018.

(51) Int. Cl.

| | |
|---|---|
| ***A47G 11/00*** | (2006.01) |
| ***B65D 25/24*** | (2006.01) |
| ***A47G 19/02*** | (2006.01) |
| ***B65D 1/22*** | (2006.01) |

(52) U.S. Cl.

CPC ..... *B65D 25/24* (2013.01); *A47G 19/02* (2013.01); *B65D 1/22* (2013.01)

(58) Field of Classification Search

CPC ..... B65D 25/24; B65D 1/22; B65D 88/56; A47G 19/02

USPC ..... 215/382, 379; 220/606, 631, 603, 608, 220/574

See application file for complete search history.

(56) References Cited

U.S. PATENT DOCUMENTS 3,100,054 A * 8/1963 Rubens ..... A47G 19/02 220/574

2014/0069884 A1* 3/2014 Paredes ..... B65D 1/10 215/44

* cited by examiner

*Primary Examiner* — Don M Anderson

*Assistant Examiner* — Elizabeth J Volz

(74) *Attorney, Agent, or Firm* — Snyder, Clark, Lesch & Chung, LLP

(57) ABSTRACT

A bowl includes an upper part having a cylindrical shape and having an opening. The bowl also includes a middle part located adjacent the upper part, wherein the opening extends into at least a portion of the middle part. The bowl further includes a lower part having a lower surface, wherein the lower surface includes a first portion that extends across a portion of the lower part and a second portion that extends across another portion of the lower part, wherein the second portion is angled with respect to the first portion.

17 Claims, 15 Drawing Sheets

CONTAINER FOR DISPLAYING CONTENTS

RELATED APPLICATION

This application claims priority under 35 U.S.C. § 119 based on U.S. Provisional Application No. 62/777,920 filed Dec. 11, 2018, the contents of which are hereby incorporated herein by reference in their entirety.

BACKGROUND INFORMATION

Conventional containers for displaying items typically must be viewed from above. For example, a bowl used to display items, such as polished stones, candies, spices, etc., must be viewed from essentially directly above the bowl in order for the viewer to see a significant portion of the contents of the bowl.

In a commercial setting, such as when a container is located on a shelf, it is often impossible for a customer to view the contents of the container. In addition, in a home setting, such as when the bowl is on a shelf or in a display cabinet, the user must remove the bowl from the shelf or open the display cabinet to view the contents of the bowl.

DETAILED DESCRIPTION OF PREFERRED EMBODIMENTS

The following detailed description refers to the accompanying drawings. The same reference numbers in different drawings may identify the same or similar elements. Also, the following detailed description does not limit the invention.

Implementations described herein relate to a container, such as a bowl for displaying items. The container (also referred to herein as a bowl) may include an upper portion that is cylindrical in shape and includes an opening to hold items of interest. The container also includes a lower portion in which the conventional cylindrical portion has been cut or formed to create an additional surface that is angled with respect to the bottom surface of the bowl. For example, the cut may be made from a middle of the lower surface extending to the outside surface of the bowl, creating an inclined surface with respect to the bottom surface. The bowl may then rest on the inclined surface when the inner portion of the bowl is filled or partially filled with items. In some implementations, the bowl may rest on the inclined surface when the inner portion of the bowl is empty. In each case, the open portion of the bowl may be angled with respect to a surface on which the bowl rests, thereby enabling all or substantially all of the inner surface of the bowl to be viewable by a person positioned in front of the bowl. This alleviates problems associated with a user having to get an overhead view of the bowl or remove the bowl from a shelf or display case in order to view the contents of the bowl.

Figure 1:
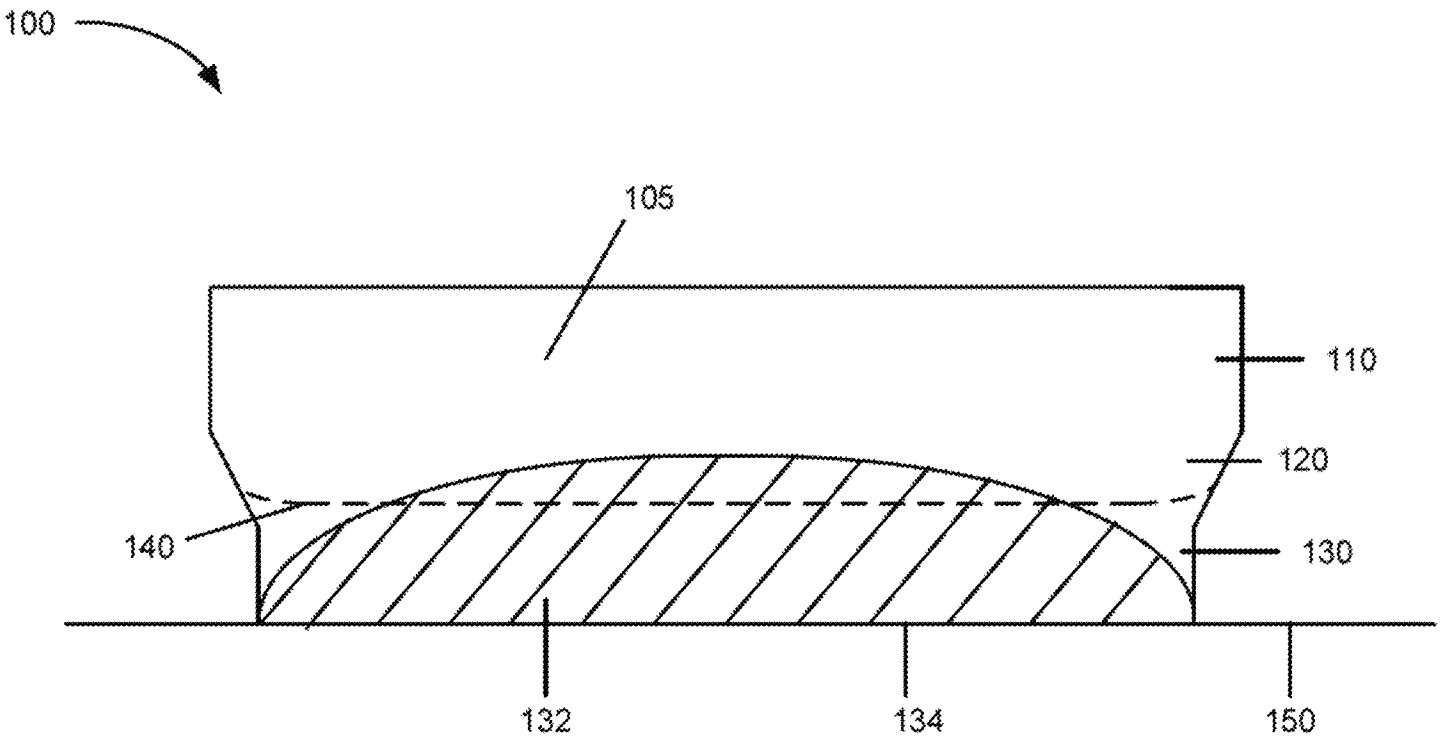
FIG. 1 is a front view of bowl in accordance with an exemplary implementation.

FIG. 1 is a front view of a bowl 100 in accordance with an exemplary implementation. Referring to FIG. 1, bowl 100 includes top portion 110 with an opening 105, a middle portion 120 and a lower portion 130. In an exemplary implementation, the top and middle portions 110 and 120 are generally cylindrical and include opening 105 that extends down through the middle portion 120 to hold items (e.g., decorative items such as polished stones, food times, such as candies or herbs, trinkets, etc.). Dotted line 140 represents the bottom or lower surface of opening 105. Lower portion 130 includes a flat lower surface 134 and a surface 132 that is inclined with respect to flat lower surface 134, as described in more detail below. The inclined surface 132 may also be inclined with respect to surface 150 on which bowl 100 rests when bowl 100 is empty, as illustrated in FIG. 1.

Figure 2:
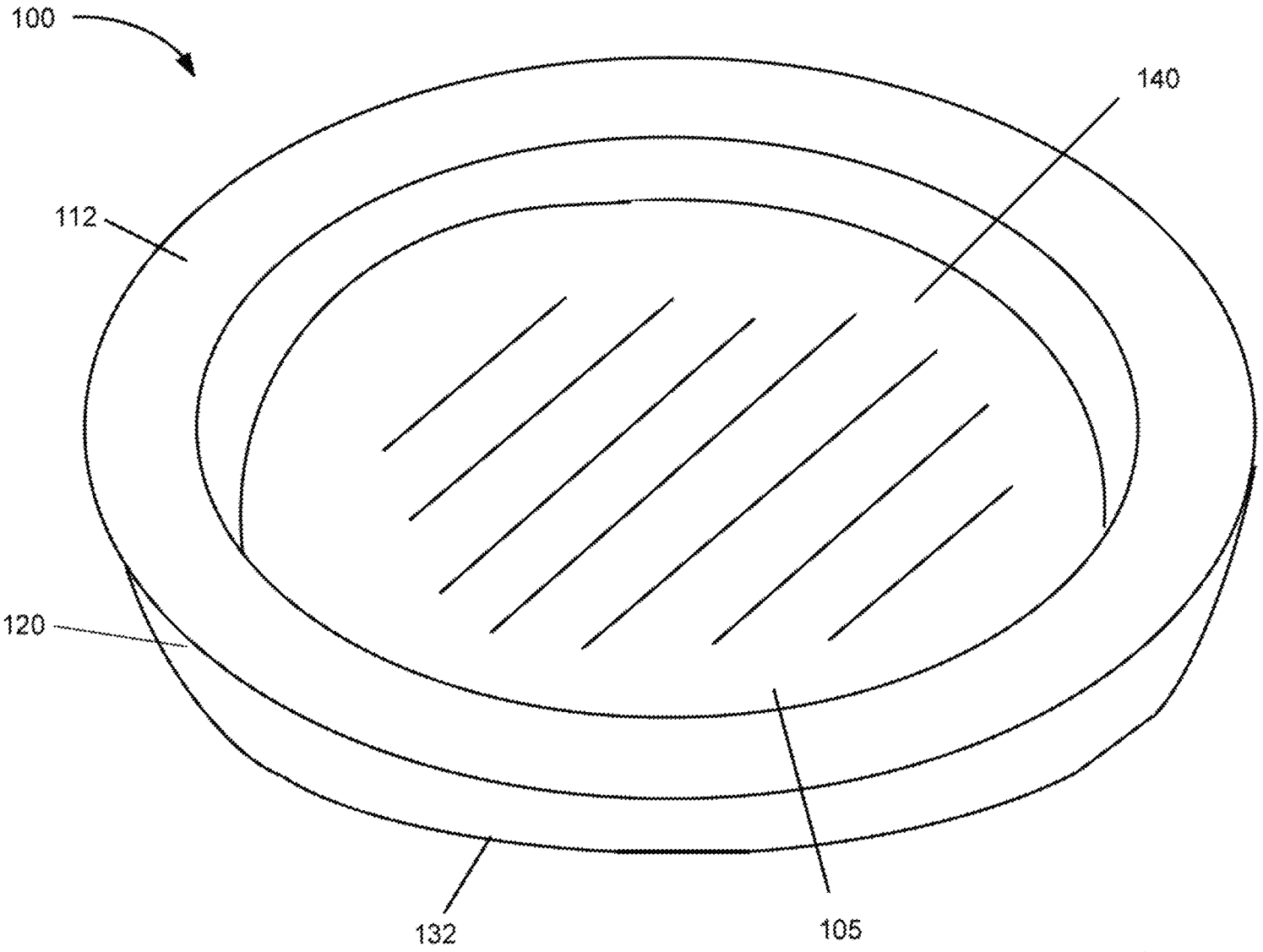
FIG. 2 is an isometric top view of the bowl of FIG. 1 in accordance with an exemplary implementation.

FIG. 2 is an isometric top view of bowl 100. As illustrated, opening 105 extends down through a portion of the middle portion 120 of bowl 100, such that opening 105 extends below top surface/rim 112 of top portion 110 to lower surface 140 of opening 105. A user may place contents on lower surface 140, which are clearly visible to a user standing in front of bowl 100 without the user having to lean over the top of opening 105. In this manner, when surface 132 rests on a table, shelf or other flat surface, the contents of bowl 100 are easily visible to a person standing in front of bowl 100.

Figure 3A:
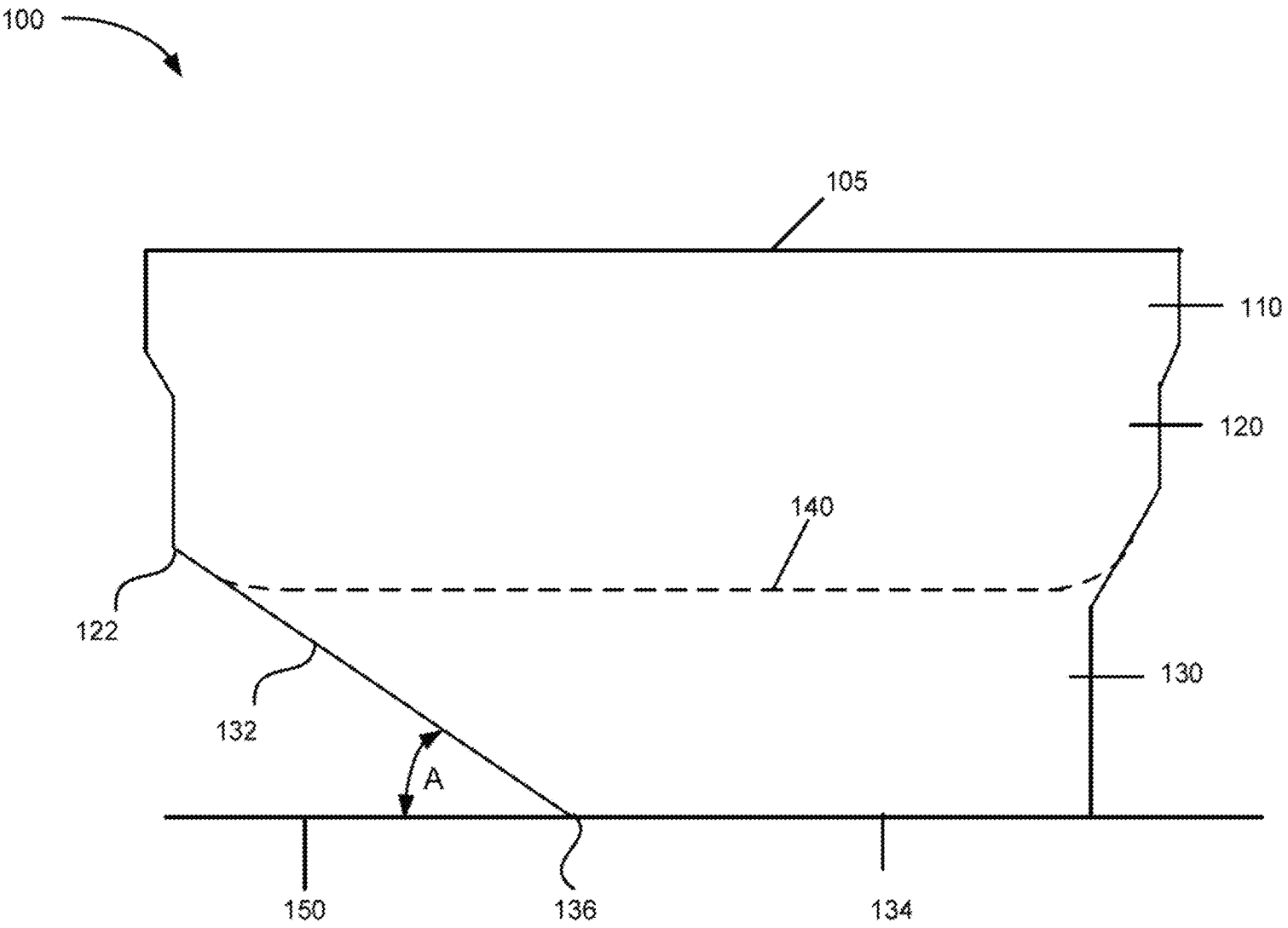
FIGS. 3A and 3B are side views of the bowl of FIG. 1 in an exemplary implementation.
Figure 3B:
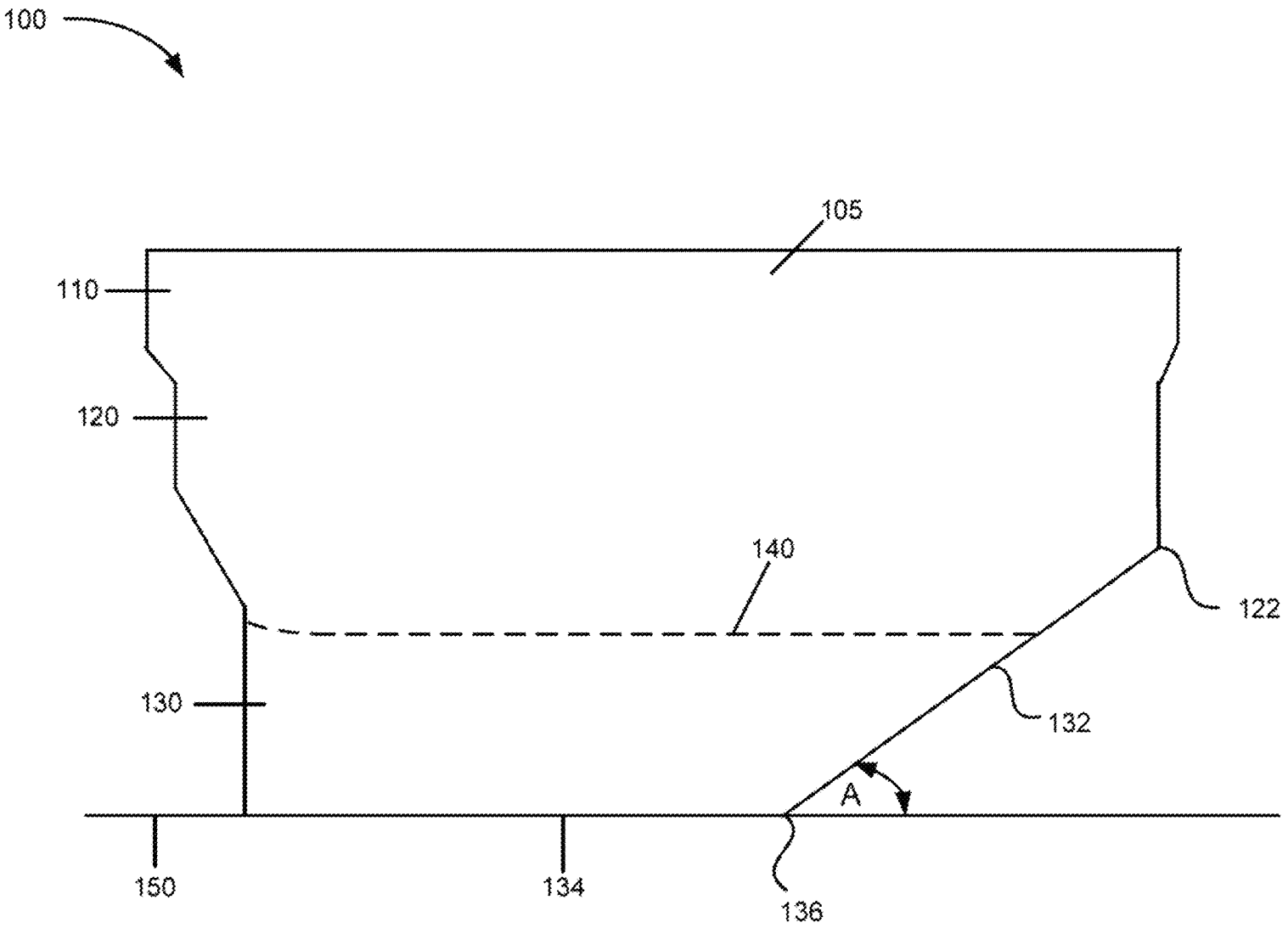

FIGS. 3A and 3B are side views of bowl 100. Referring to FIG. 3A, lower portion 130 includes inclined surface 132 and flat surface 134. Surface 134 may rest on surface 150 (e.g., a table, shelf, etc.) when bowl 100 is empty. Inclined surface 132 may extend from lower surface 134 and may be formed by cutting the lower portion of bowl 100 to remove a wedge-shaped portion of lower portion 130 and middle portion 120. Alternatively, inclined surface 132 may be formed integrally with respect to top portion 110 and middle portion 120. According to one implementation, inclined surface 132 may begin at point 136 on the lower surface 134 of bowl 100 and extend up to the middle portion 120 of bowl 100 to point 122. The angle of surface 132 with respect to surface 134, illustrated as A in FIG. 3A, may vary based on the particular implementation. For example, the angle A may range from about 15 degrees to about 75 degrees (e.g., 20 degrees to 45 degrees). The angle A may also vary based on the height, width and weight of bowl 100, the materials used to fabricate bowl 100 (e.g., plastic, wood, composite, etc.), as well as other factors such as the desired display angle with respect to displaying contents of bowl 100. For example, if bowl 100 is going to be viewed from a distance (e.g., greater than five feet), angle A may be greater to allow for easier viewing. FIG. 3B illustrates a side view of bowl 100 with bowl 100 rotated 180 degrees with respect to FIG. 3A.

As described above, in accordance with one implementation, bowl 100 may configured to rest on bottom surface 134 when bowl 100 is not filled with items, as illustrated in FIGS. 3A and 3B. That is, surface 134 contacts/rests on surface 150 when bowl 100 is empty. When bowl 100 is filled or partially filled with items (e.g., placed in opening 105), bowl 100 is configured to tilt such that surface 132 rests on a flat surface that is parallel to the floor, such as surface 150 (e.g., a table, shelf, etc.), as illustrated in FIG.

4. In other implementations, bowl 100 may be configured to rest on surface 132 when bowl 100 is empty.

Figure 4:
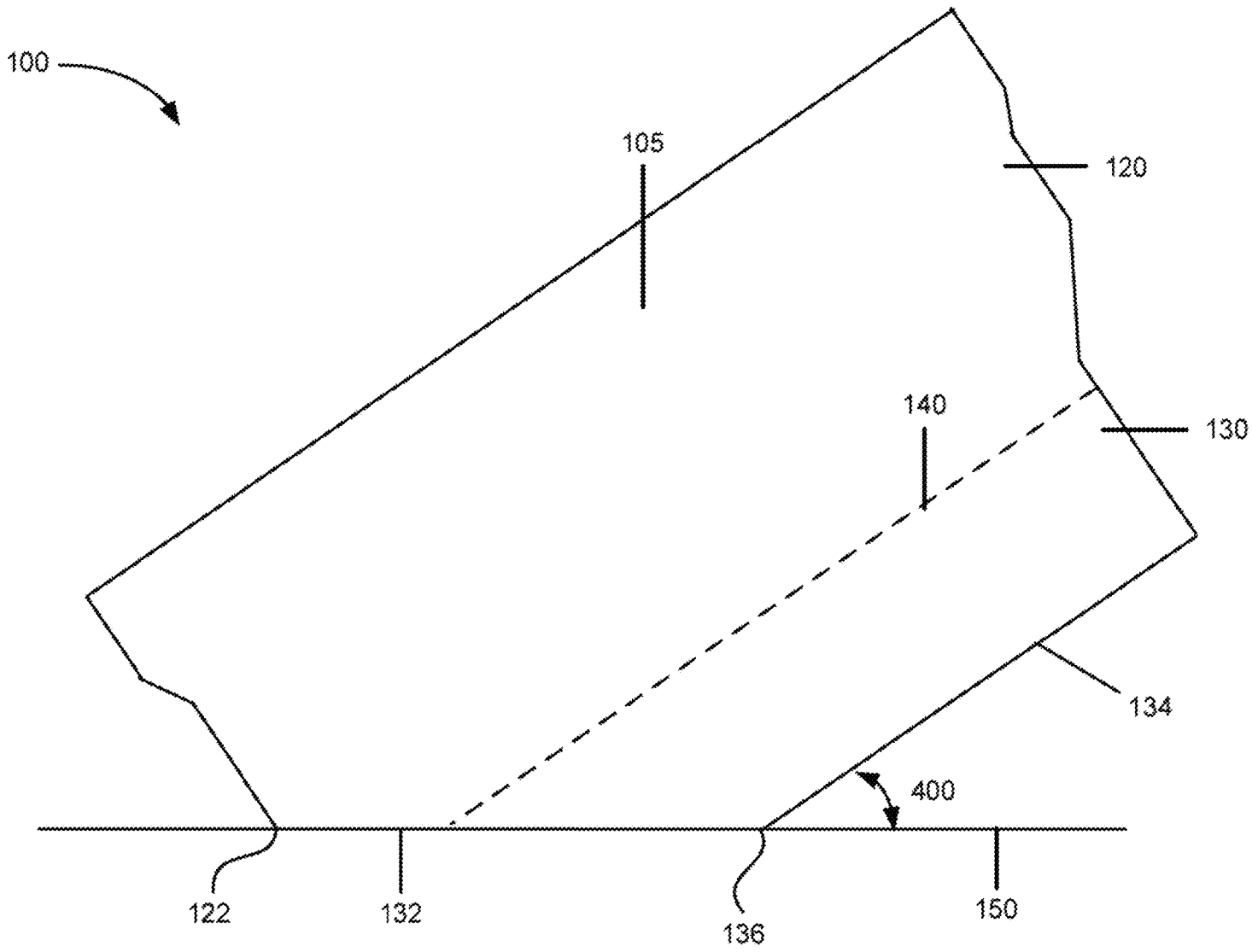
FIG. 4 is another side view of the bowl of FIG. 1 in which the opening of the bowl is viewable from the front in accordance with an exemplary implementation.

FIG. 4 illustrates bowl 100 with surface 132 contacting or being supported by surface 150 (e.g., a table, shelf, etc.). As illustrated, surface 134 no longer rests on surface 150 and forms an angle (labeled 400 in FIG. 4) with respect to surface 150. In an exemplary implementation, angle 400 may range from about 15 degrees to above 75 degrees and may be the same as angle A in FIG. 3A. That is, when the front of bowl 100 tilts forward, the rear side of bowl (e.g., surface 134) raises by the same angular amount. In this manner, when bowl 100 is filled or partially filled, the weight of the contents creates a moment that causes surface 132 to move downwardly such that surface 132 rests on surface 150, as illustrated in FIG. 4. Alternatively, a user may simply touch the front of top portion 110 to apply a small amount of force to cause the front of bowl 100 to move downwardly such that surface 132 rests on surface 150. In still other implementations and as discussed above, bowl 100 may be configured to rest on surface 132 when bowl 100 is empty.

In each case, opening 105 of bowl 100 is inclined with respect to surface 150 and most or all of the inside of opening 105 is viewable to a person standing in front of bowl 100. This enables a user to place items in his/her bowl 100 and be able to easily see the contents of bowl 100 without having to remove bowl 100 from a shelf, remove bowl 100 from a display cabinet, etc.

Figure 5:
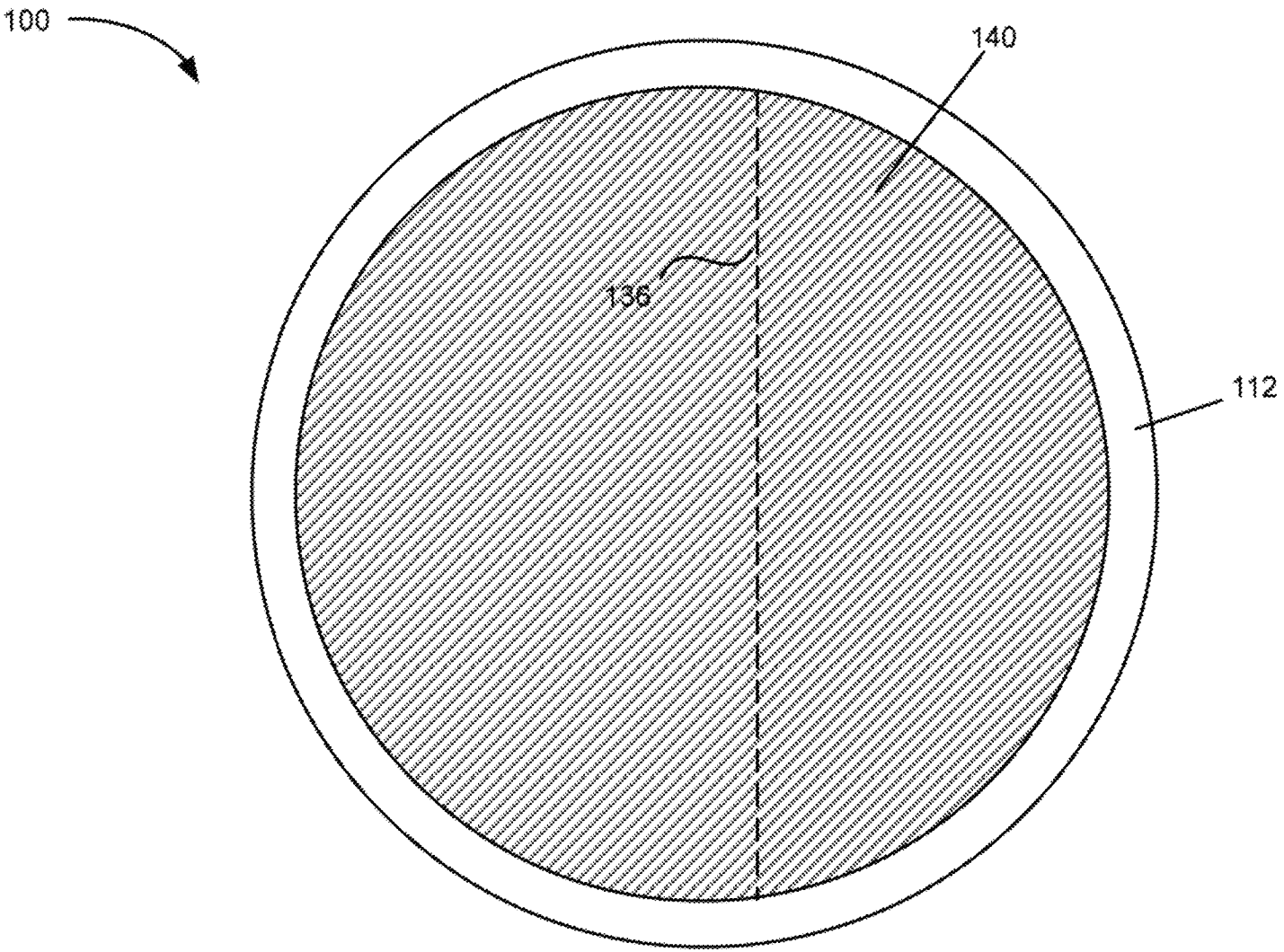
FIG. 5 is a top view of the bowl of FIG. 1 in accordance with an exemplary implementation.
Figure 6:
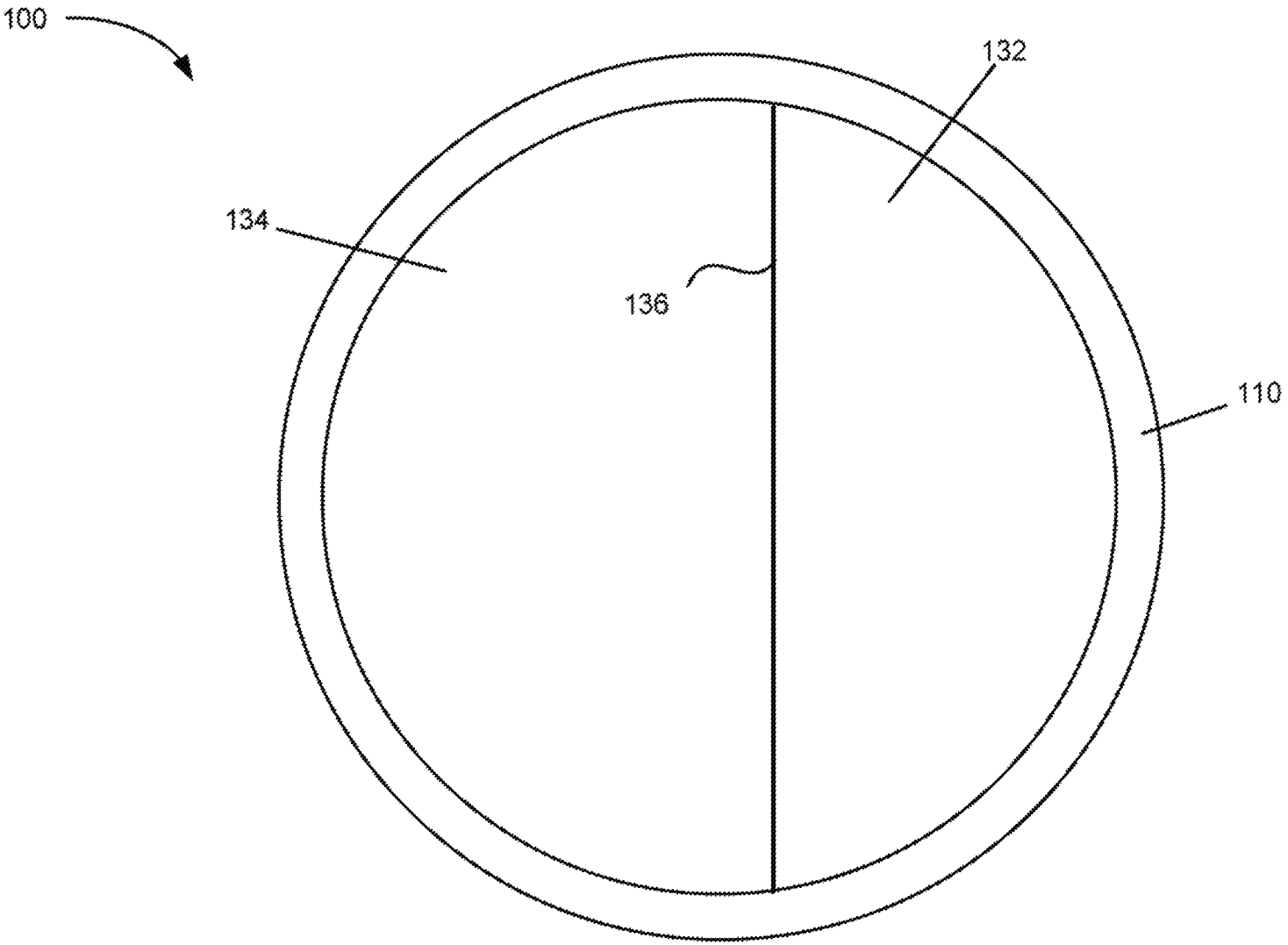
FIG. 6 is a bottom view of the bowl of FIG. 1 in accordance with an exemplary implementation.

FIG. 5 is a top view of bowl 100 and FIG. 6 is a bottom view of bowl 100 in accordance with an exemplary implementation. Referring to FIG. 5, opening 105 may be filled or partially filled by a user with items of interest, such as decorative items, food, candies, herbs, etc. (not shown). Referring to FIG. 6, bottom surface of bowl 100 includes flat surface 134 and inclined or slanted surface 132. As discussed previously, inclined surface 132 may slope or angle upwardly toward the middle portion of bowl 120 to point 122 (FIG. 4). As also described previously, in one implementation, a manufacturer may cut a cylindrical bowl after forming the bowl to remove a wedge-shaped portion to create inclined surface 132. In other implementations, such as when bowl 100 is made of a plastic or composite material, bowl 100 may be manufactured using a mold having the desired shape illustrated in FIGS. 3A, 3B and 4.

Figure 7:
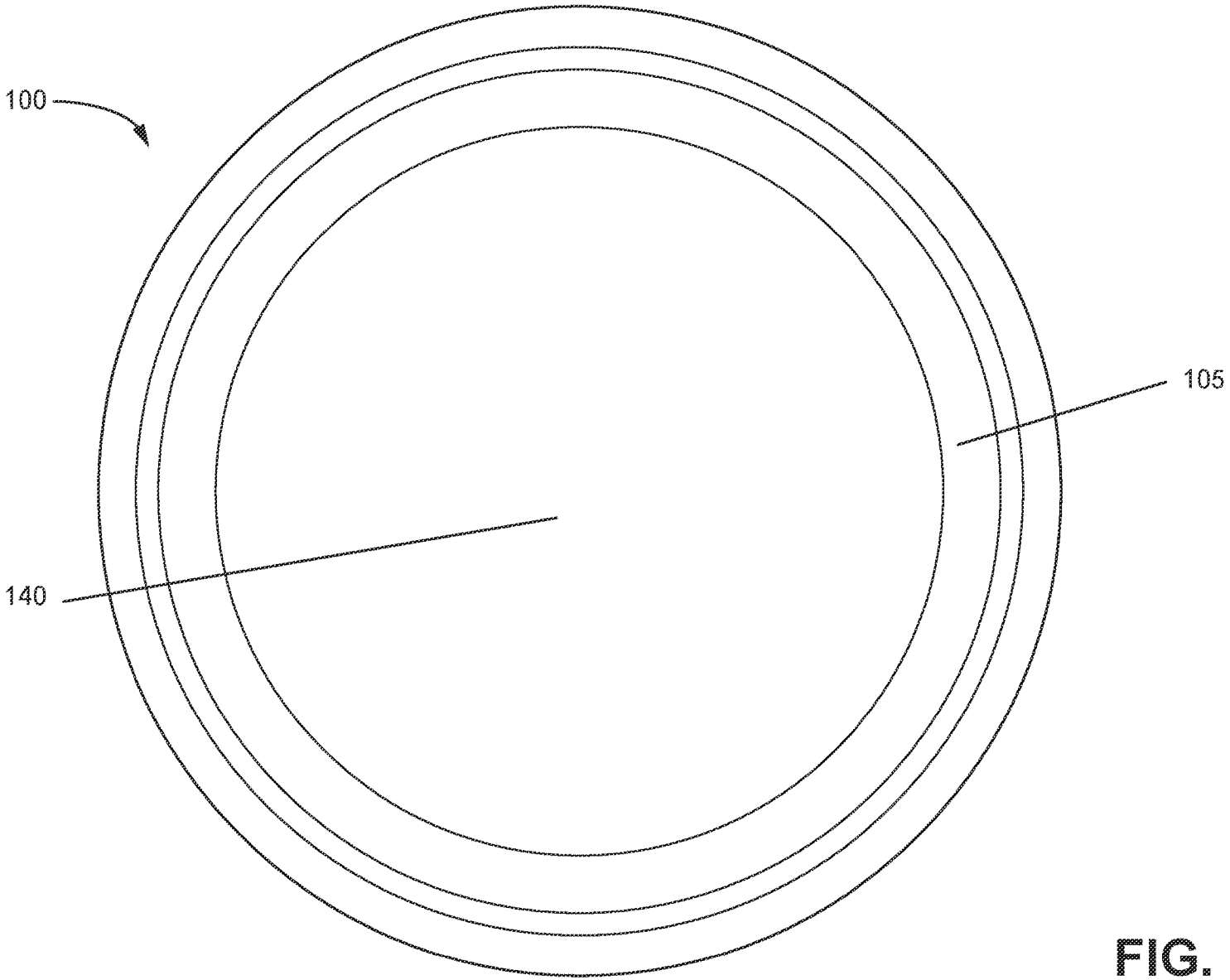
FIGS. 7-14 are diagrams of a bowl in accordance with an exemplary implementation.
Figure 8:
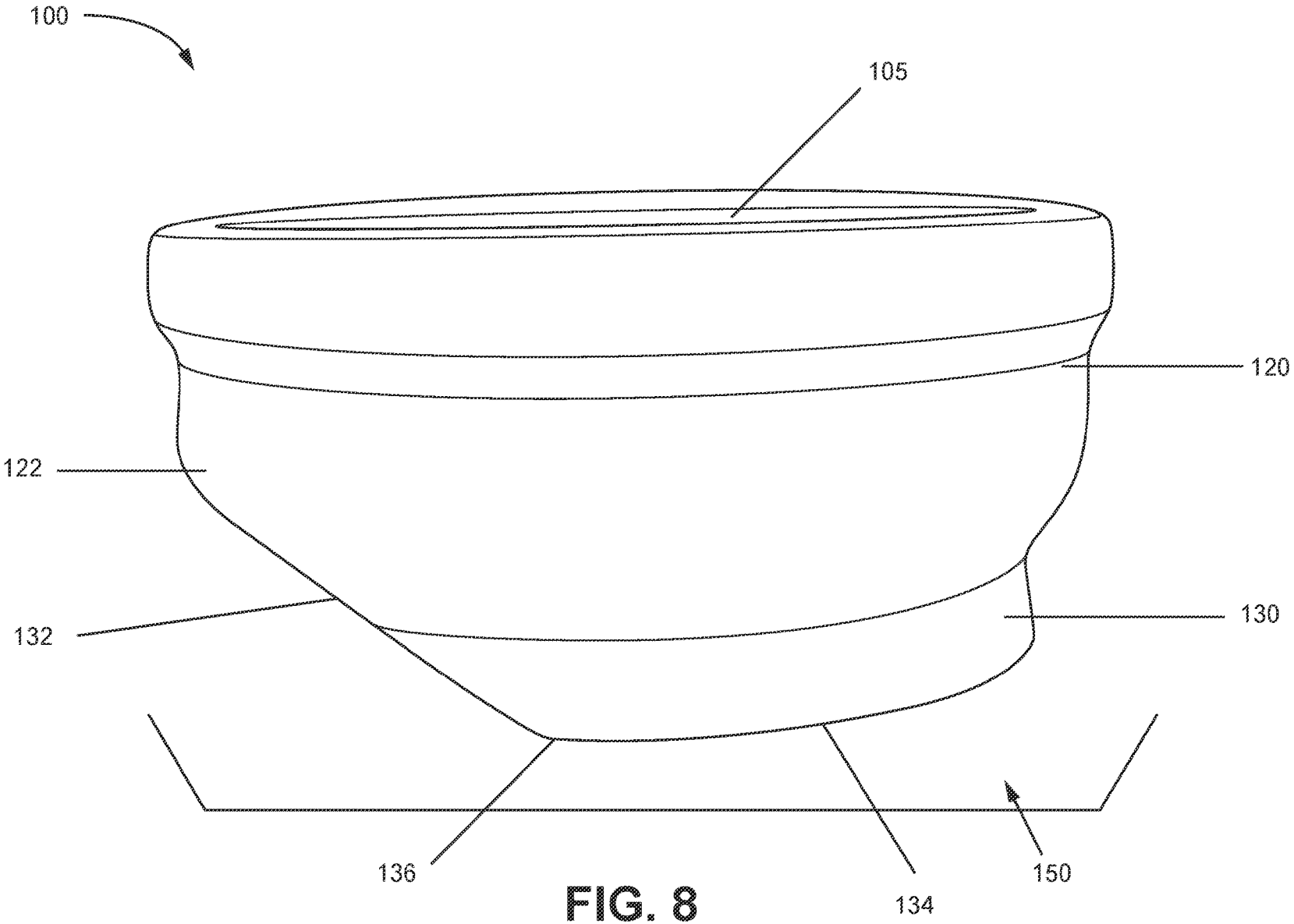

FIGS. 7-14 are diagrams of bowl 100 in accordance with an exemplary implementation. More particularly, FIG. 7 illustrates a top view of bowl 100 with opening 105 and lower portion 140 of opening 105 shown. Items to be displayed may be placed on lower surface 140 of opening 105. FIG. 8 is a diagram of a side view of bowl 100. As illustrated, lower portion 130 includes flat surface 134 and inclined surface 132. While bowl 100 is empty (e.g., no items placed inside opening 105), flat surface 134 of bowl 100 may rest on a flat surface, such as table 150 illustrated in FIG. 8.

Figure 9:
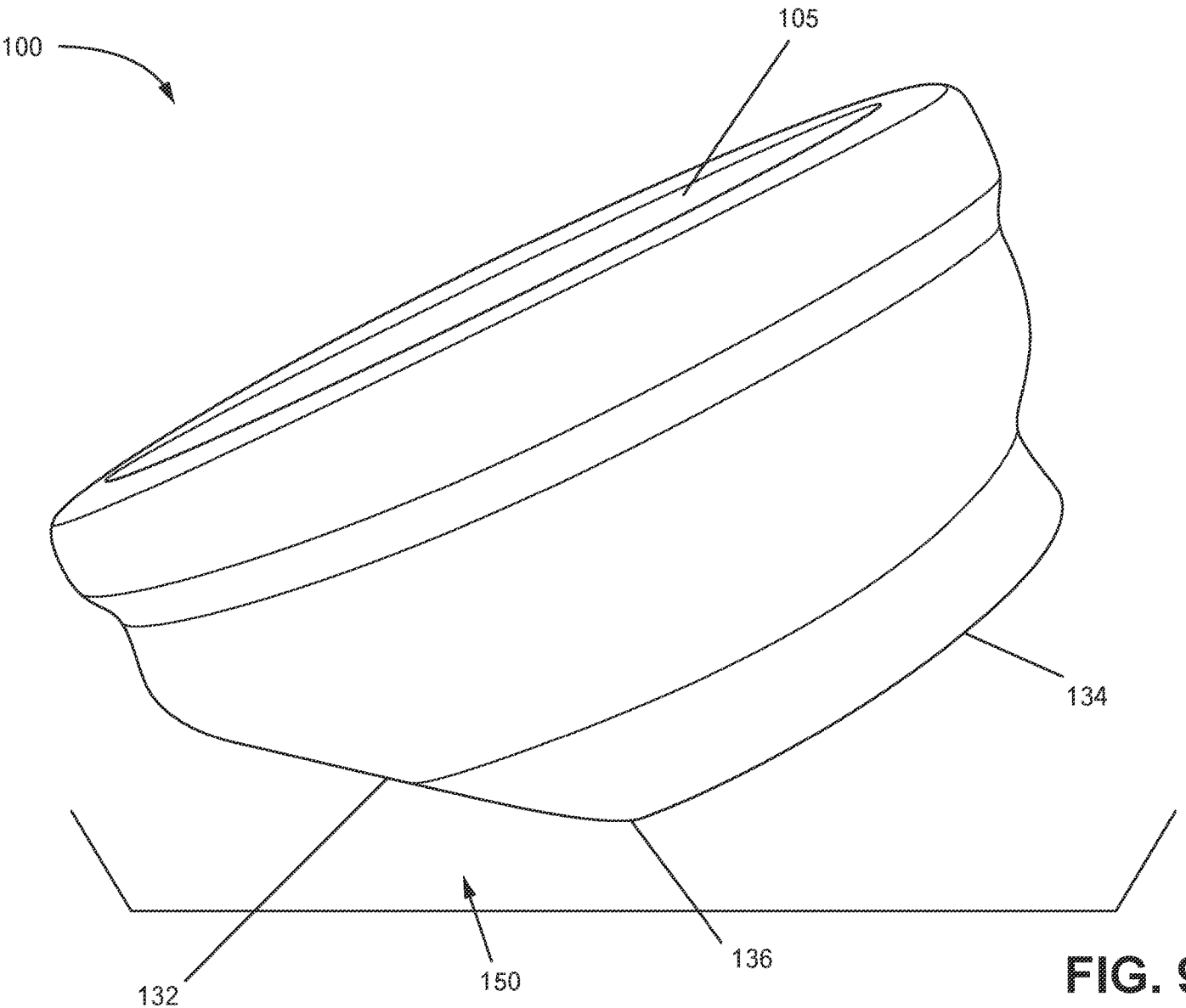

Referring to FIG. 9, when items are placed in opening 105, bowl 100 tips such that surface 134 becomes elevated above table 150 and surface 132 rests on table 150. In this situation, the opening 105 of bowl 100 may be visible to a view standing in front of bowl 100 to allow the viewer to see all or nearly all of the contents of bowl 100.

Figure 10:
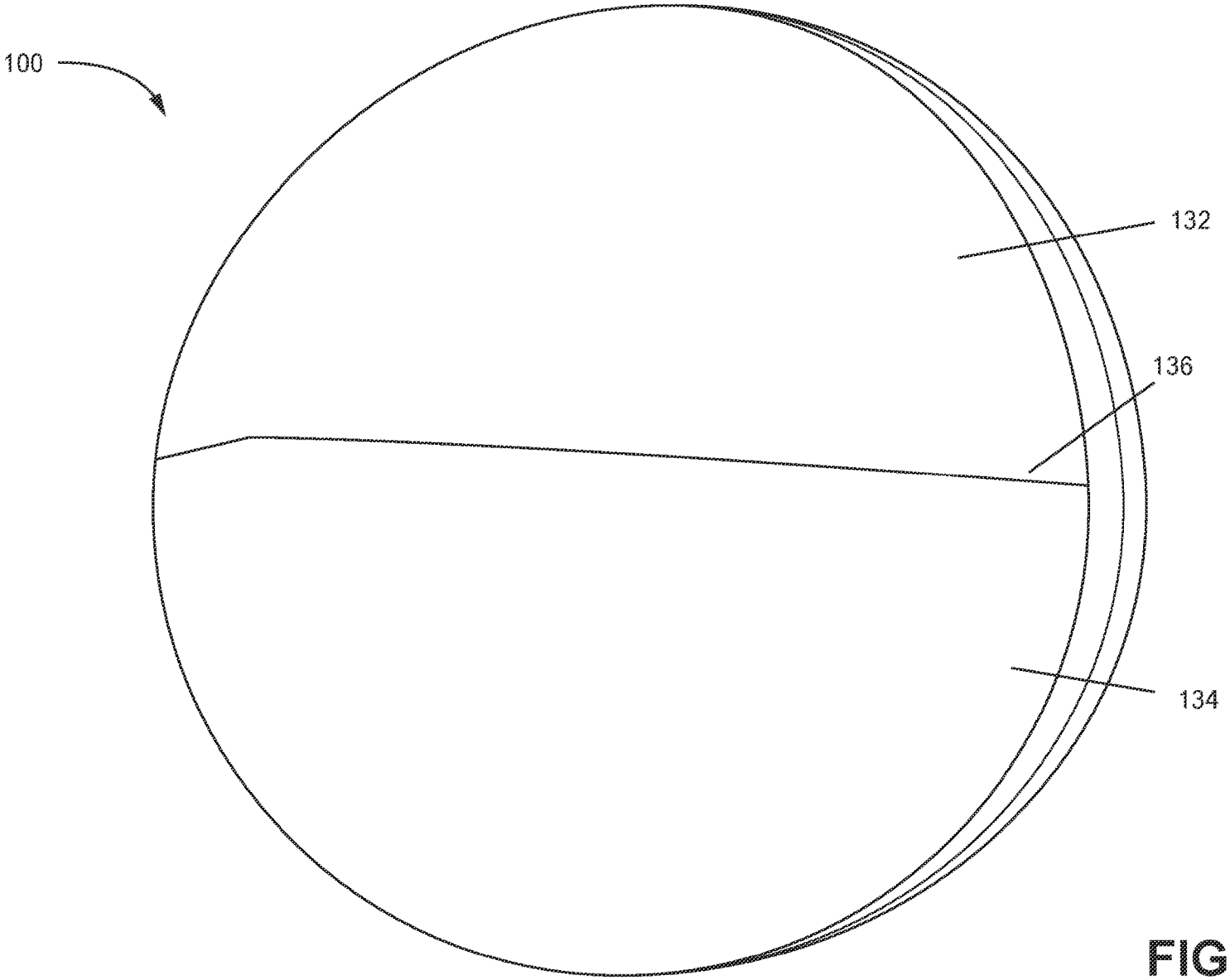

FIG. 10 is a diagram of the bottom surface of bowl 100. The flat surface 134 contacts a surface (e.g., table 150) on which bowl 100 rests when bowl 100 is empty, as shown in FIG. 8. The inclined surface 132 contacts a surface (e.g., table 150) on which bowl 100 rests when bowl 100 is filled or partially filled, as shown in FIG. 9.

Figure 11:
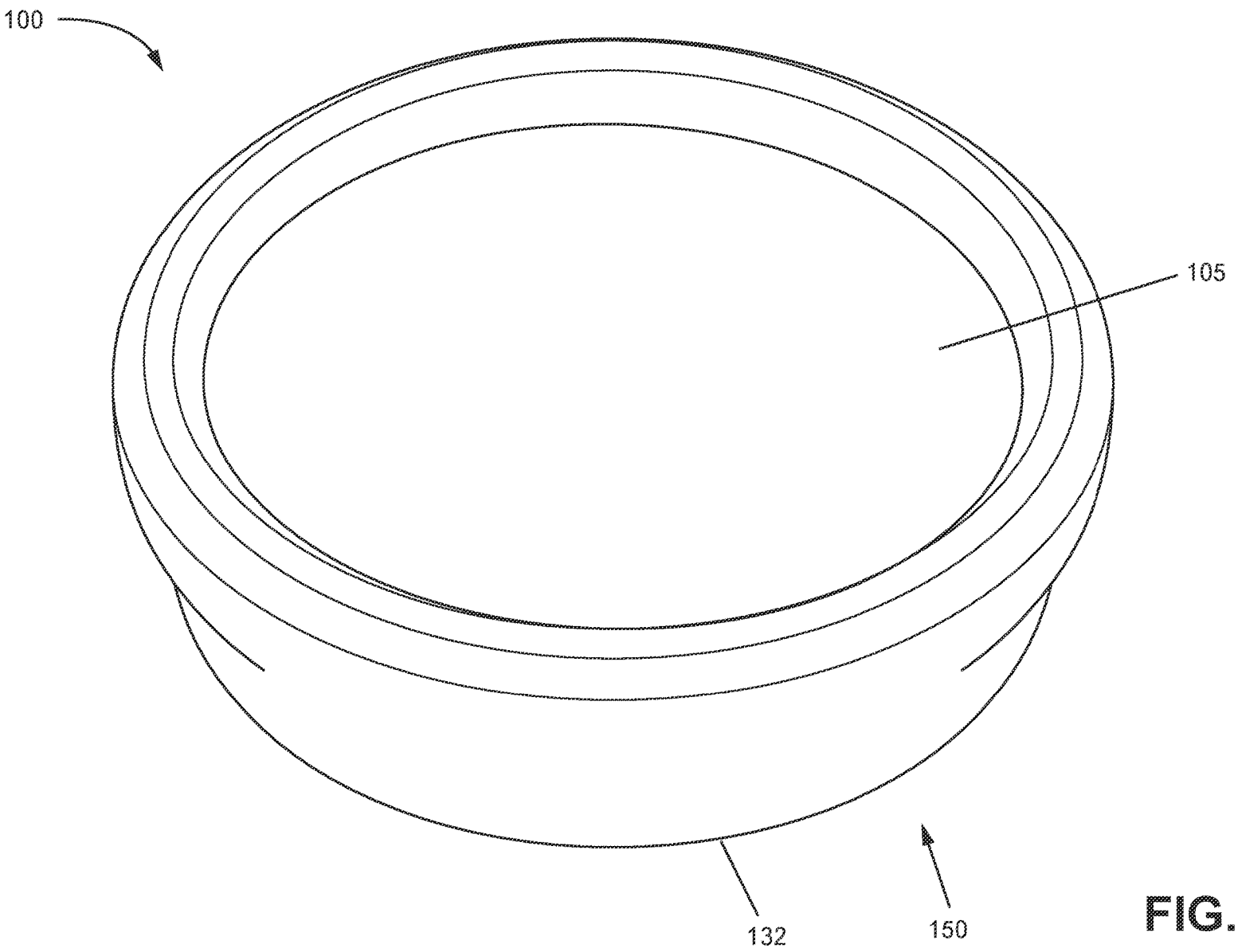
Figure 12:
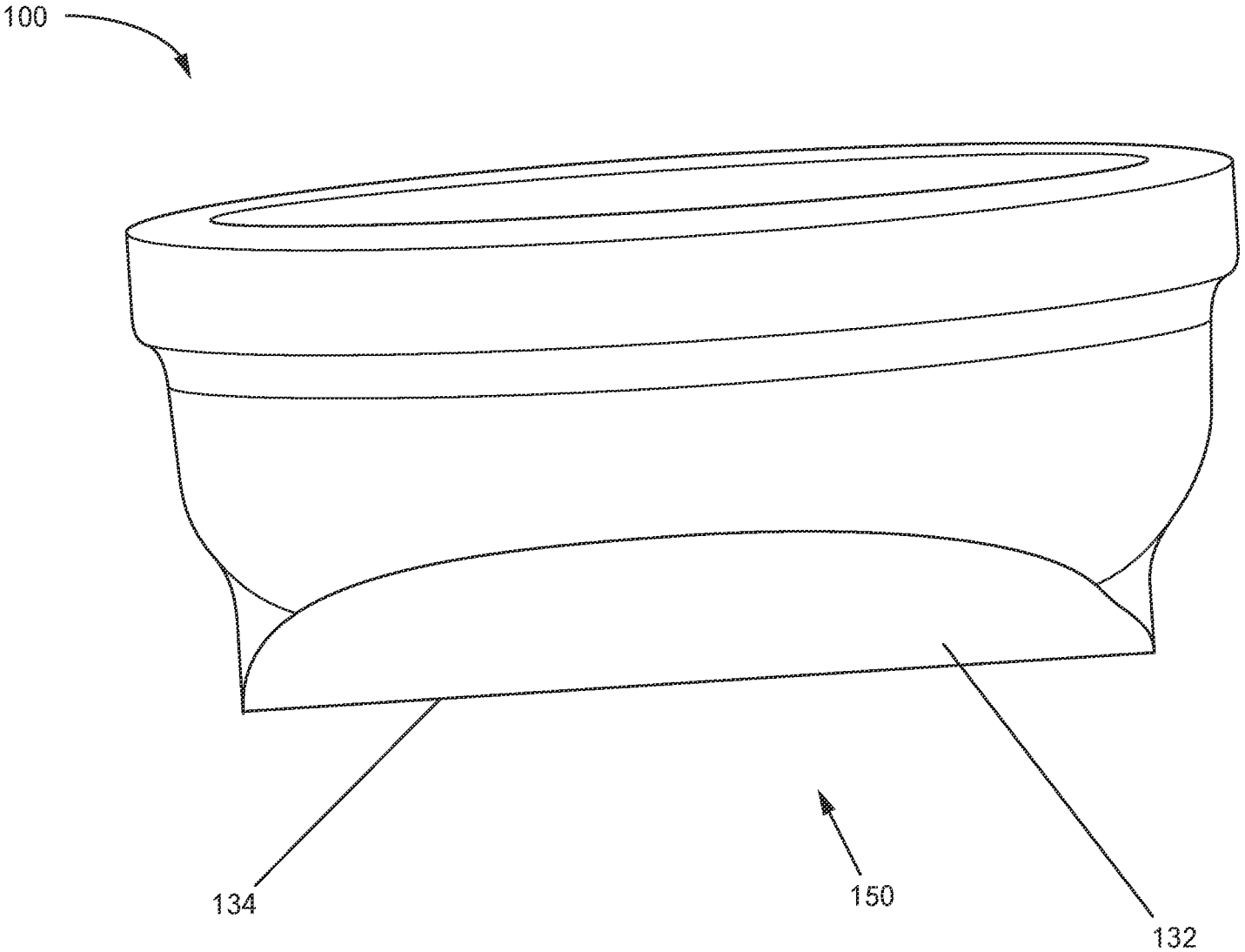

FIG. 11 is a diagram of a front view of bowl 100 with surface 132 contacting table 150. In this diagram, although bowl 100 is empty, bowl 100 has been tilted such that surface 132 rests on table 150 to illustrate that a front view of bowl 100 exposes all or nearly all of the interior opening 105 of bowl 100. In this manner, if bowl 100 were filled or partially filled, a viewer could see the contents from the front, without having to remove bowl 100 from table 150. FIG. 12 is a diagram of a front view of bowl 100 with inclined surface 132 visible. In this diagram, surface 134 contacts or rests on table 150.

Figure 13:
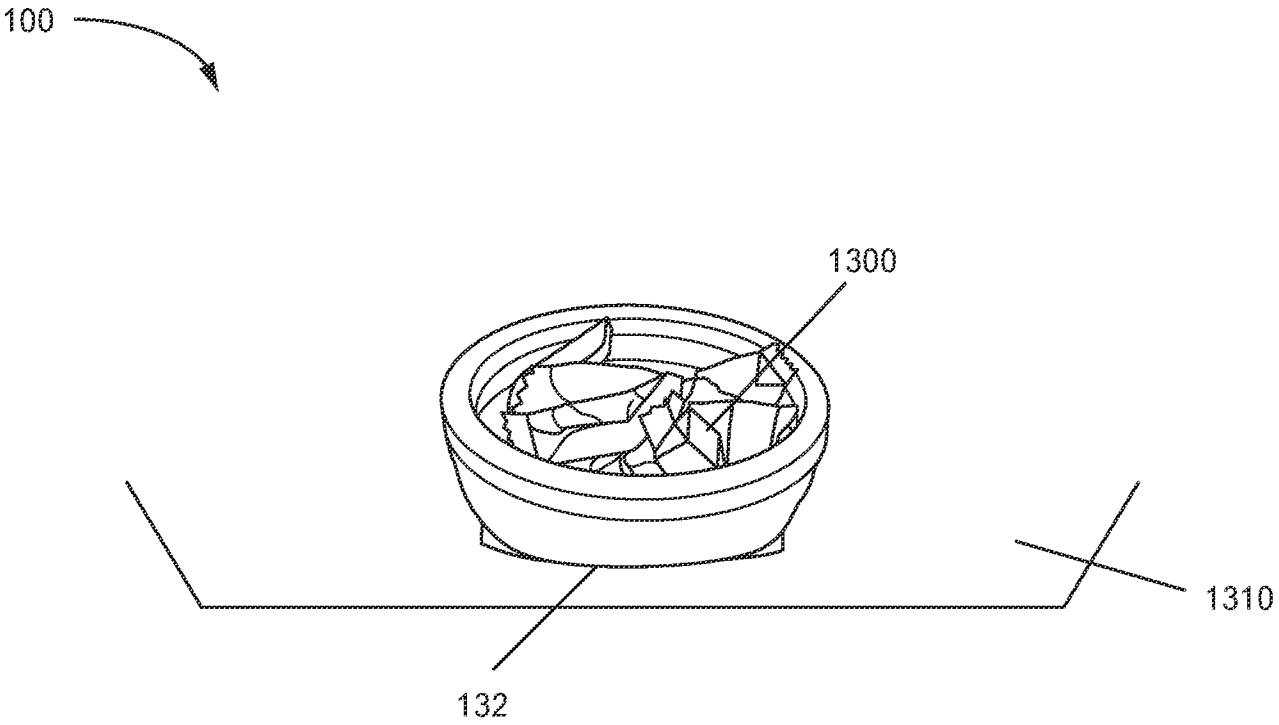
Figure 14:
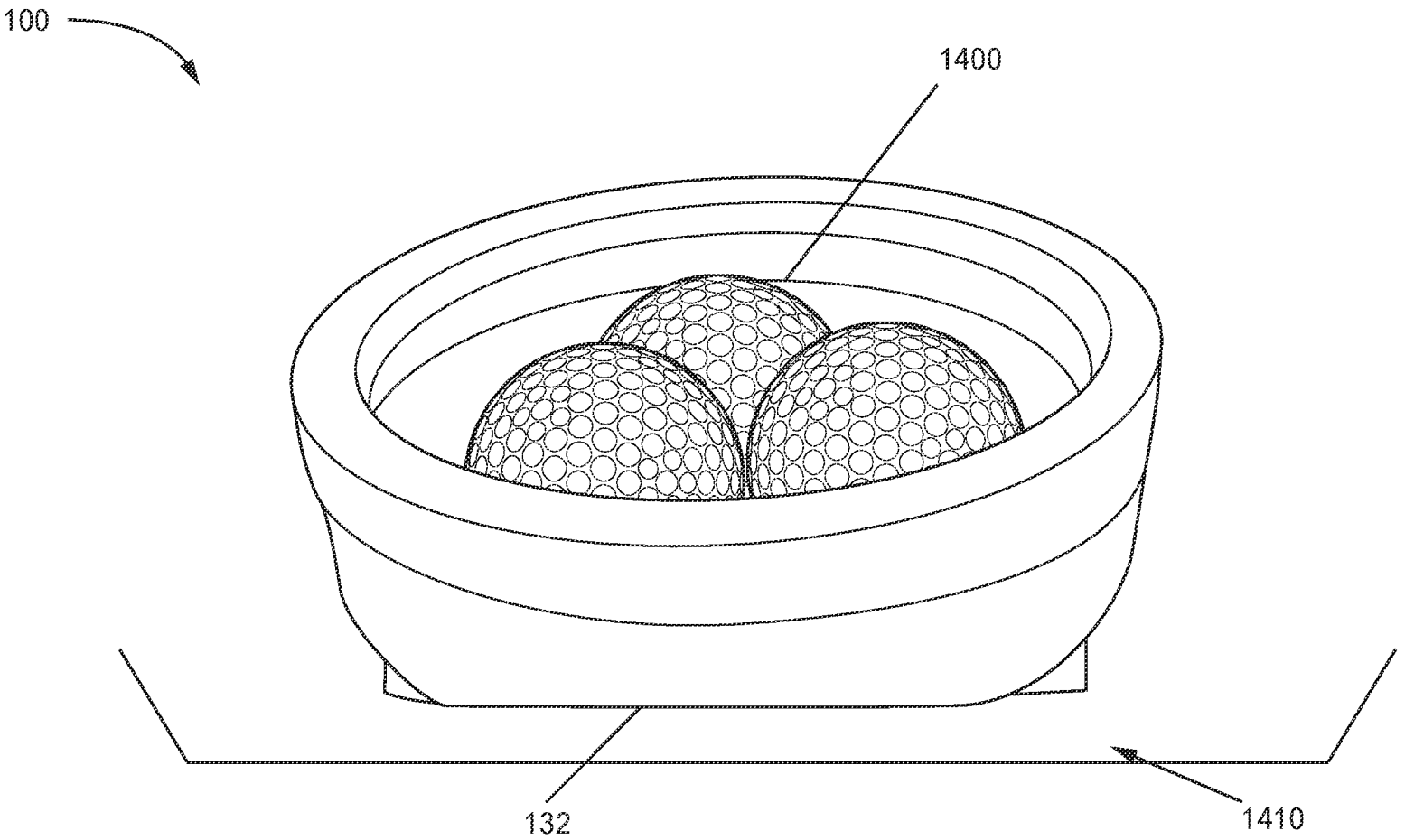

FIG. 13 illustrates a diagram of a front view of bowl 100 with contents 1300 (e.g., candy in this example) being visible from the front when bowl 110 is placed on a shelf 1310. In this diagram, surface 132 contacts or rests on shelf 1310. FIG. 14 illustrates another diagram of a front view of bowl 100 with contents 1400 (e.g., golf balls in this example) being visible from the front of bowl 100 when bowl is place on a table 1410. Similar to FIG. 13, in this diagram, surface 132 contacts or rests on table 1410.

As described above, bowl 100 provides a viewer standing in front of bowl 100 with the ability to view all or most of the contents of bowl 100. Each bowl formed in accordance with implementations described herein includes a bottom surface that includes a flat surface and an inclined surface. The particular dimensions of each of these surfaces may be based on the size of the bowl (height, width, weight, etc.), the type of material with which the bowl is made, the type of items to be displayed in bowl 100, the weight of items to be displayed in bowl 100, etc. In each case, bowl 100 may be engineered to rest on surface 134 when unfilled (or be tilted to rest on surface 132 when bowl 100 is empty/includes no items), and to rest on surface 132 to display the interior of bowl 100 when bowl 100 is filled or partially filled with items. For example, bowl 100 may be engineered such that that sum of the moments with respect to point 122 is zero when bowl 100 is empty (i.e., no items are within opening 105), so that bowl 100 may be stable and rest on surface 134 when bowl 100 is empty. In other implementations, as discussed above, bowl 100 may be engineered to rest on surface 132 when bowl 100 is empty (e.g., includes no items in opening 105).

In one exemplary implementation, bowl 100 may be approximately 2⅝ inches tall and have an outer circumference at top portion 110 of approximately 5¼ inches. In this example, lower surface 132 may be approximately 2½ inches in length and flat surface 134 may be approximately 2½ inches in length. In this example, point 136 at which inclined surface 132 starts is approximately the middle of bowl 100 (e.g., aligned with the middle of opening 105). However, it should be understood that in other implementations, inclined surface 132 may have a steeper angle or shallower angle with respect to flat surface 134. For example, inclined surface 132 may begin its upward slope closer to the outer rim of the lower portion 130 of bowl 100 adjacent flat surface 134 (e.g., to provide a greater/steeper angle), or begin its upward slope further away from the outer rim of the lower portion 130 adjacent flat surface 130 (e.g., to provide a smaller/shallower angle). That is, the angle of inclination may determine the location of demarcation point 136 at which inclined surface 132 begins.

Implementations described herein provide a container in which the inside portion of the container is easily viewable from the front. This enables a user to display items of interest without having to pick up the container, remove the container from a shelf, lean over the top of the container, etc.

The foregoing description of exemplary implementations provides illustration and description, but is not intended to be exhaustive or to limit the embodiments to the precise form disclosed. Modifications and variations are possible in light of the above teachings or may be acquired from practice of the embodiments.

For example, aspects have been described with respect to bowl having a particular shape, such as generally cylindrical. In other implementations, bowl 100 or a container may have other shapes, such as generally rectangular, hexagonal, ovoid, etc.

In the preceding specification, various preferred embodiments have been described with reference to the accompanying drawings. It will, however, be evident that various modifications and changes may be made thereto, and additional embodiments may be implemented, without departing from the broader scope of the invention as set forth in the claims that follow. The specification and drawings are accordingly to be regarded in an illustrative rather than restrictive sense.

No element, act, or instruction used in the description of the present application should be construed as critical or essential to the invention unless explicitly described as such. Also, as used herein, the article "a" is intended to include one or more items. Further, the phrase "based on" is intended to mean "based, at least in part, on" unless explicitly stated otherwise.

What is claimed is:

1. A bowl, comprising:

an upper part having a cylindrical shape and including an opening;

a middle part located adjacent the upper part, wherein the opening extends into at least a portion of the middle part, wherein the opening has a widest diameter in the upper part of the bowl; and a lower part having a lower surface, wherein the lower surface comprises a first portion that extends across a portion of the lower part and a second portion that extends across another portion of the lower part, wherein the second portion is angled with respect to the first portion, and wherein the weight of items placed in the opening causes the bowl to tilt such that the second portion of the lower surface is configured to contact a flat surface on which the bowl is placed when the opening is filled or partially filled with the items, such that substantially all of the items are visible to a person positioned in front of the bowl, and wherein the second portion of the lower surface is angled with respect to the first portion of the lower surface at a location beginning at the center of the bowl.

2. The bowl of claim 1, wherein the first portion of the lower surface is configured to contact the flat surface when the opening is not filled.

3. The bowl of claim 2, wherein the angle of the second portion with respect to the first portion ranges from about 15 degrees to about 75 degrees.

4. The bowl of claim 1, wherein the second portion extends to the middle part.

5. The bowl of claim 1, wherein the bowl is configured to tilt downwardly when a force is applied to the upper part of the bowl or when items are placed in the opening, such that the items are visible to a user located in front of the bowl and without the user having to obtain a view of the bowl from directly over the bowl.

6. The bowl of claim 1, wherein the second portion of the lower surface is configured to contact a flat surface on which the bowl is placed when the opening is not filled.

7. The bowl of claim 1, wherein the bowl comprises wood, plastic or a composite material.

8. The bowl of claim 1, wherein the first portion of the lower surface is equal in length to the second portion of the lower surface.

9. A container, comprising:

an upper part including an opening; and a lower part comprising:

a first surface, wherein the first surface comprises a flat portion that extends across a portion of the lower part, and a second surface that is angled with respect to the first surface, wherein the second surface is configured to contact a flat surface on which the container is placed when the opening is filled or partially filled, wherein substantially all of the opening is visible to a person positioned in front of the container when the second surface contacts the flat surface, wherein the second surface is angled with respect to the first surface at a location beginning at the center of the container, and wherein the opening has a widest diameter in the upper part of the container.

10. The container of claim 9, wherein the first surface is configured to contact the flat surface when the opening is not filled.

11. The container of claim 9, wherein the angle of the second surface with respect to the first surface ranges from about 15 degrees to about 75 degrees.

12. The container of claim 9, wherein the second surface extends upwardly from the first surface to at least a middle part of the container located between the upper part and the lower part.

13. The container of claim 9, wherein the first surface extends approximately to a middle of the container.

14. The container of claim 9, wherein the container is configured to tilt downwardly when a force is applied to the upper part of the container or when items are placed in the opening, such that the items are visible to a user located in front of the container and without the user having to obtain a view of the container from directly over the container.

15. The container of claim 9, wherein the second surface is configured to contact the flat surface on which the container is placed when the opening includes no items.

16. The container of claim 9, wherein the container comprises wood, plastic or a composite material.

17. The container of claim 9, wherein the first surface and second surface are equal in length.

* * * * *